US006808146B2

(12) United States Patent
Swan

(10) Patent No.: US 6,808,146 B2
(45) Date of Patent: Oct. 26, 2004

(54) MERCHANDISE DISPLAY

(76) Inventor: Richard L. Swan, 6155 Phirmas St. #212, Reno, NV (US) 89509

( * ) Notice: Subject to any disclaimer, the term of this patent is extended or adjusted under 35 U.S.C. 154(b) by 0 days.

(21) Appl. No.: 10/158,070

(22) Filed: May 31, 2002

(65) Prior Publication Data

US 2003/0221345 A1 Dec. 4, 2003

(51) Int. Cl.[7] ..... F16M 11/00; A41H 5/00
(52) U.S. Cl. ..... 248/127; 223/66; 223/68
(58) Field of Search ..... 248/127, 175.5, 248/196.6, 10; 40/539; 223/66, 68

(56) References Cited

U.S. PATENT DOCUMENTS

| | | | | |
|---|---|---|---|---|
| 1,041,917 A | | 10/1912 | Waddington | |
| 1,736,313 A | | 11/1929 | Heyman | |
| 2,318,774 A | | 5/1943 | Goldsmith | |
| 2,665,040 A | * | 1/1954 | Reid | 223/68 |
| 3,225,489 A | | 12/1965 | Ryan | |
| 3,501,072 A | * | 3/1970 | Kovener | 223/66 |
| 4,360,134 A | * | 11/1982 | Goldberg | 223/66 |
| 4,666,048 A | * | 5/1987 | Strongosky et al. | 211/170 |
| 4,821,341 A | * | 4/1989 | Baptiste | 2/10 |
| 5,201,077 A | * | 4/1993 | Dondlinger | 2/209.3 |
| 5,584,134 A | * | 12/1996 | Chaput | 40/539 |
| 5,624,041 A | * | 4/1997 | Van Druff et al. | 211/30 |
| 5,924,129 A | * | 7/1999 | Gill | 2/10 |
| 6,233,745 B1 | * | 5/2001 | Friesen | 2/172 |
| D474,327 S | * | 5/2003 | Giesen et al. | D2/891 |

OTHER PUBLICATIONS

Gator Sports, Inc.; Neoprene Helmet Liner with Fleece Lining; 1 sheet.

* cited by examiner

*Primary Examiner*—Anita M. King
(74) *Attorney, Agent, or Firm*—Rolance, Abrams, Berdo & Goodman L.L.P.

(57) ABSTRACT

A merchandise display, comprising a substantially planar display board having the form of a profile of a human head including a headwear portion, a head portion, and a neck portion. Merchandise is mounted to the display board. The merchandise includes a main section and a strap. The strap engages the headwear portion of the display board. The main section is suspended from the strap and covers a part of the head portion, thereby displaying the merchandise on the display board as the merchandise would appear in normal use.

50 Claims, 6 Drawing Sheets

MERCHANDISE DISPLAY

FIELD OF THE INVENTION

The present invention relates to a display for merchandise. More specifically, the present invention relates to a merchandise display that displays the merchandise on a board having the shape of a human profile so that the merchandise is displayed as it would appear in normal use.

BACKGROUND OF THE INVENTION

Conventional merchandise displays typically either hang or package the merchandise. Hung merchandise commonly includes a tag with some type of identifying and/or instructional indicia. Packaged merchandise usually includes a label or insert with the identifying and/or instructional indicia placed within the package or attached to the outside of the package.

However, these conventional merchandise displays fail to provide the consumer with an accurate and complete visual indication of what the merchandise being displayed is and how it is used. A consumer must instead read the merchandise tag or package label to determine what the merchandise is and what it is used for. This often prevents the consumer from obtaining information about the merchandise prior to purchase. Moreover, conventional merchandise displays are often expensive requiring elaborate packaging or display materials.

SUMMARY OF THE INVENTION

Accordingly, an object of the present invention is to provide a merchandise display that allows a consumer to clearly see what the merchandise is and how it is used.

Another object of the present invention is to provide a merchandise display that is simple and inexpensive to manufacture.

The foregoing objects are basically attained by a merchandise display, comprising a substantially planar display board that has the form of a profile of a human head with a headwear portion, a head portion, and a neck portion. Merchandise is mounted to the display board. The merchandise includes a main section and a strap. The strap is mounted to the headwear portion of the display board with the main section being suspended from the strap and covering a part of the head portion, thereby displaying the merchandise on the display board as the merchandise would appear in normal use.

The foregoing objects are also basically attained by a merchandise display, comprising a substantially planar display board that has the form of a profile of a human head with a headwear portion that has the shape of a cap including a bill, a head portion, a neck portion, and first and second opposing side edges. Indicia is disposed on a display side of the display board. Merchandise is mounted to the display board. The merchandise includes a flexible main section and a flexible strap extending from a top edge of the main section. The strap is mounted to the headwear portion of the display board and engages the first side edge thereof. The top edge of the main section engages the second side edge of the display board. The main section is suspended from the strap and covers the second side edge of the display board at the head portion, thereby displaying the merchandise on the display board as the merchandise would appear in normal use.

By fashioning a merchandise display in this manner, a potential consumer can see the merchandise as it would appear in normal use, such as a sun shade worn over a cap of a wearer, providing protection for the ears and back of the neck of the wearer.

Other objects, advantages and salient features of the invention will become apparent from the following detailed description, which, taken in conjunction with annexed drawings, discloses the preferred embodiments of the present invention.

BRIEF DESCRIPTION OF THE DRAWINGS

Referring to the drawings which form a part of this disclosure.

DETAILED DESCRIPTION OF THE INVENTION

Figure 1:
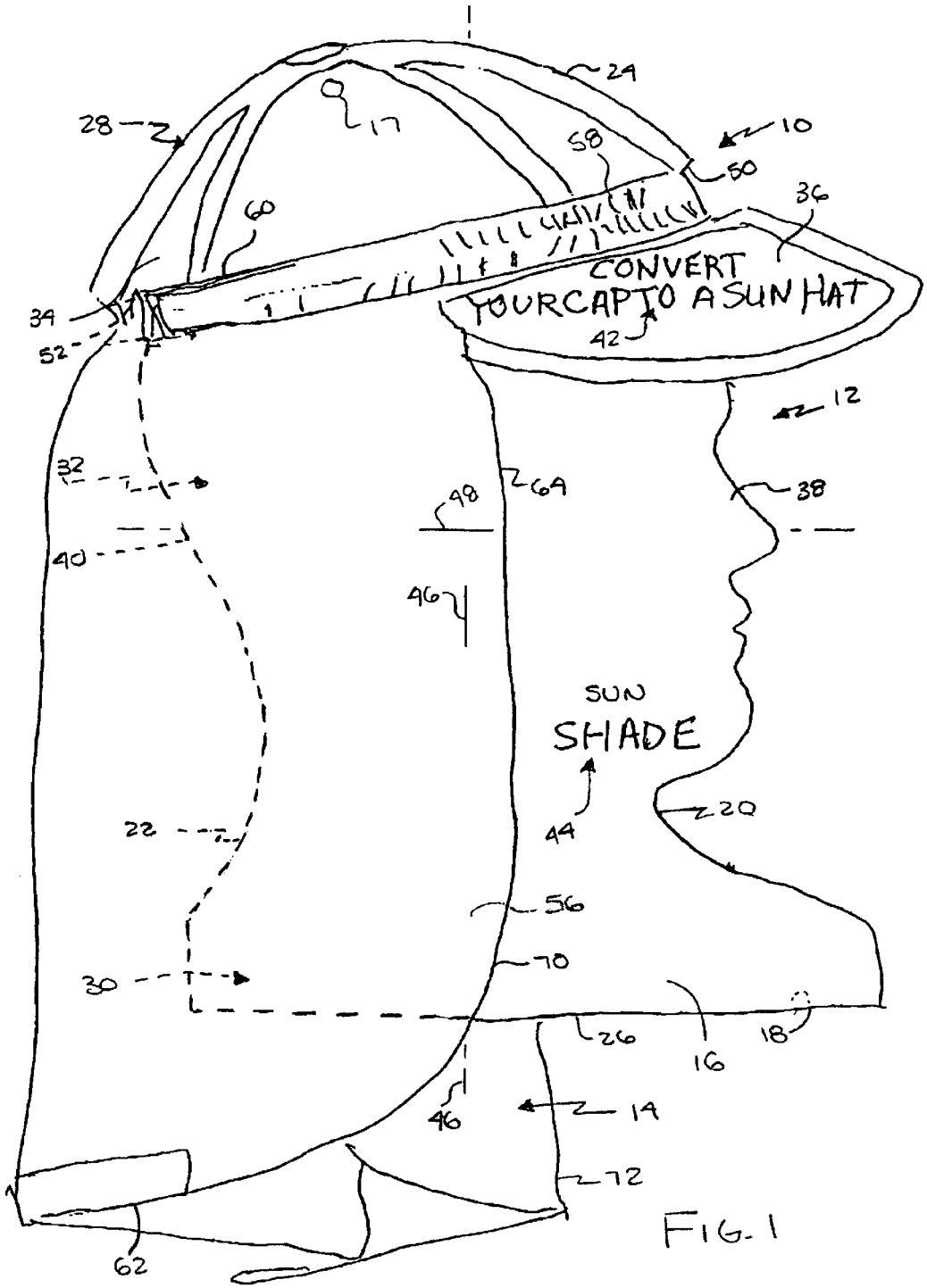
FIG. 1 is a side elevational view of a merchandise display in accordance with a first embodiment of the present invention, showing merchandise displayed on a display board.

Referring to FIGS. 1–5, a merchandise display 10 in accordance with a first embodiment of the present invention generally includes a display board 12 with a piece of merchandise or a product 14, such as a sun shade, mounted thereto. Display board 12 is in the form of a human profile with a cap worn thereon allowing display of sun shade 14 as it would generally appear in normal use. Display 10 is preferably supported or hung via aperture 17 in display board 12, however, any known support can be used such as a stand.

Display board 12 includes a display side 16 and a back side 18 opposite display side 16. Opposite first and second side edges 20 and 22 and opposite top and bottom edges 24 and 26 define the outer perimeter of display board 12. Display board 12 includes a headwear portion 28 generally near top edge 24, a neck portion 30 generally near bottom edge 26, and a head portion 32 located between headwear portion 28 and neck portion 30 so that display board 12 depicts the profile of a human head with headwear, such as a cap, worn thereon.

Figure 2:
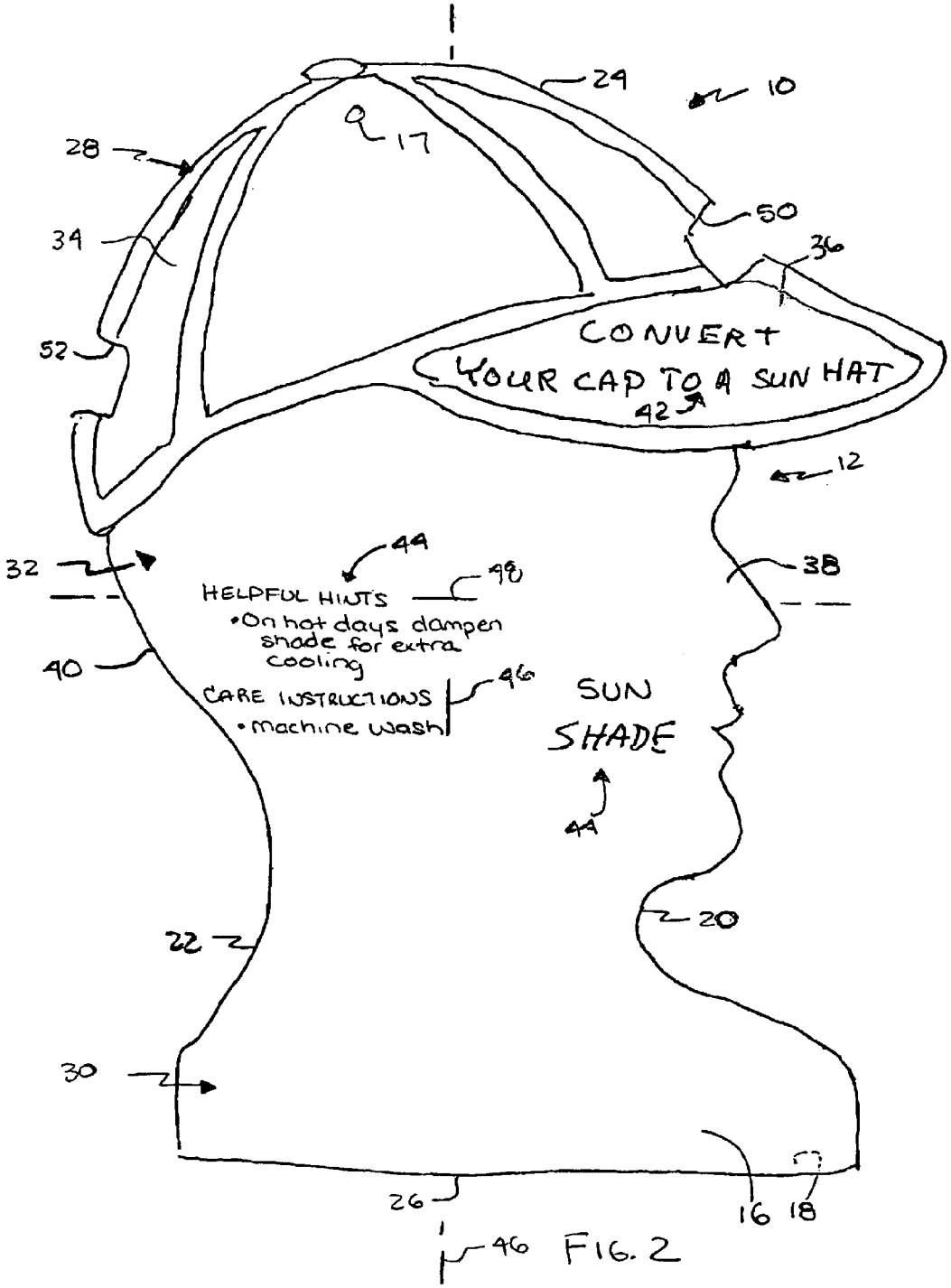
FIG. 2 is a side elevational view of the display board illustrated in FIG. 1, showing the display board without the merchandise displayed thereon.

As best seen in FIG. 2, headwear portion 28 of display board 12 is preferably in the shape of a conventional cap 34 including a bill 36. Head portion 32 includes an outline of a human face 38 at the first side edge 20 of display board 12, and includes an outline of the back of a human head 40 at the second side edge 22. Indicia 42 is disposed on the display side 16 of display board 12. Indicia 42 can include an outline of cap 34 and bill 36 at head portion 28, but can be any type of indicia such as identifying or instructional indicia. Also, indicia 44 is disposed on neck and head portions 30 and 32 on the display side 16 of board 12. Indicia 44 is preferably identifying or instructional indicia but can be any type of indicia. Display side 16 is preferably colored to provide an aesthetically pleasing appearance.

Display board 12 is preferably substantially planar and made of a semi-rigid material, such as plastic or cardboard. Display board 12 is preferably formed as a unitary one-piece board and has a length defined between top and bottom edges 24 and 26 at a center line 46 of about 12 to 14 inches and a width defined between edges 20 and 22 at a line 48 traverse to center line 46 of about 7 to 9 inches. However, the length and width of display board 12 can be any dimension desired.

First and second notches 50 and 52 are disposed on display board 12 at headwear portion 28 for supporting sun shade 14. Specifically, first notch 50 is located at first side edge 20 of board 12 adjacent bill 36 and second notch 52 is located at second side edge 22 opposite bill 36. First and second notches 50 and 52 are shaped to accommodate portions of sun shade 14.

Figure 3:
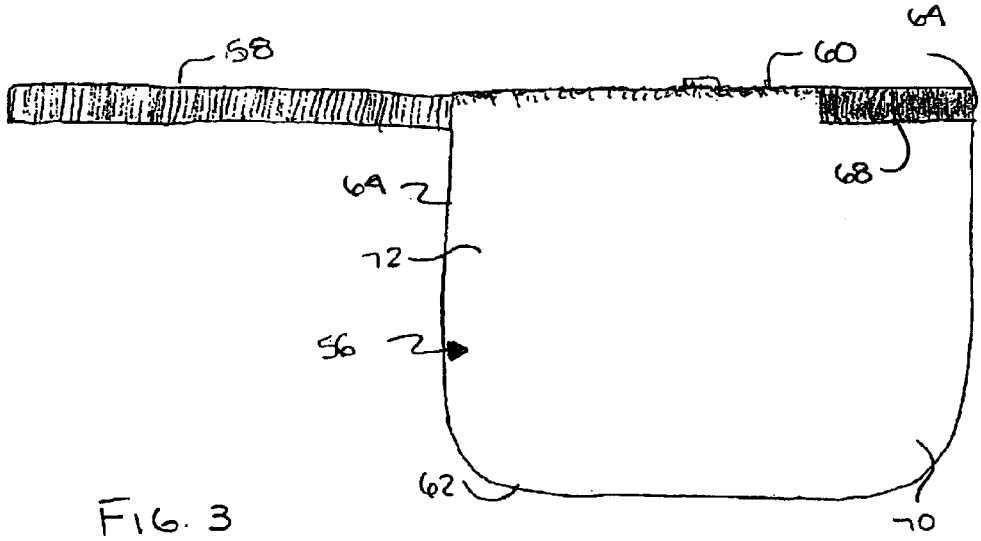
FIG. 3. is a side elevational view of the merchandise illustrated in FIG. 1, showing a first side of the merchandise.
Figure 4:
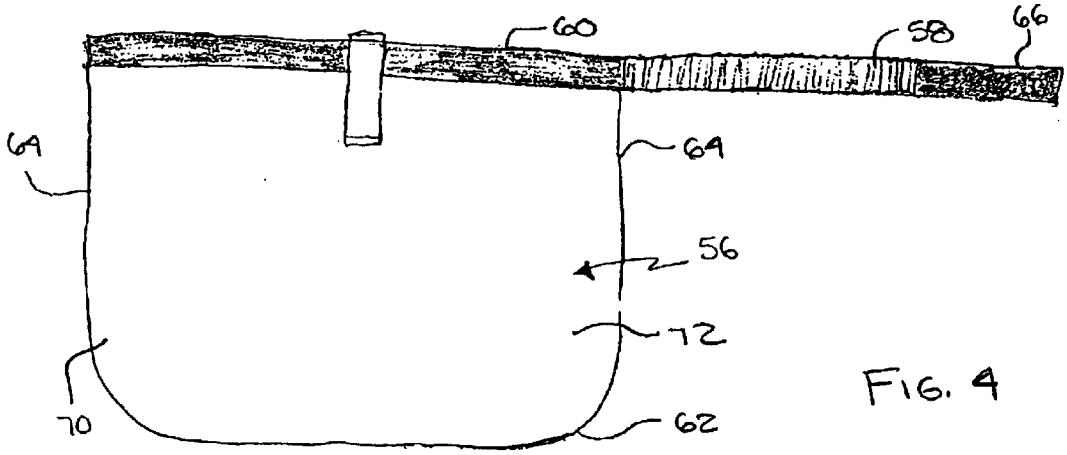
FIG. 4. is a side elevational view of the merchandise illustrated in FIG. 1, showing a second side of the merchandise.

As best seen in FIGS. 1, 3 and 4, sun shade 14 includes a main section 56 and a strap 58 extending therefrom. Main section 56 has a top edge 60 from which strap 58 extends, a bottom curved edge 62, and two side edges 64. Main section 56 is preferably made of a flexible material, such as fabric. The fabric preferably substantially blocks ultraviolet rays. Strap 58 is preferably made of a flexible material, such as fabric, and also includes elastic material allowing adjustability in strap 58. Strap preferably includes a fastener 66, such as hook and loop, that releasably engages a corresponding fastener 68 on the top edge 60 of main section 56.

Figure 5:
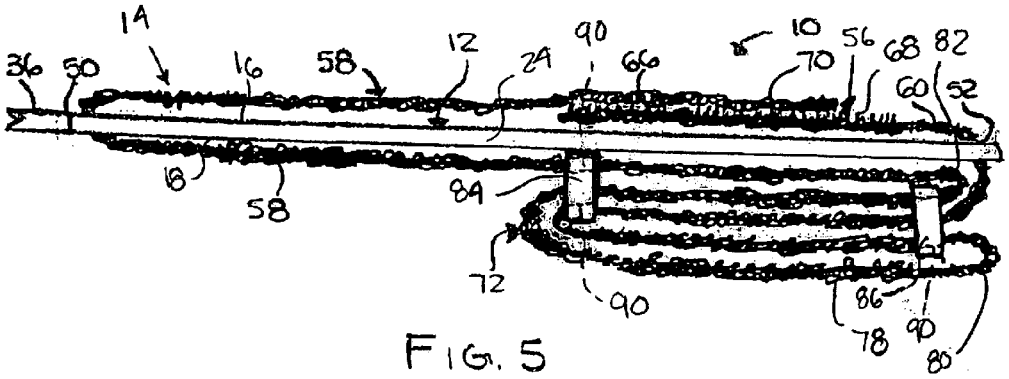
FIG. 5 is a top plan view of the merchandise display illustrated in FIG. 1, showing a folded portion of the merchandise when mounted on the display board.

As best seen in FIG. 5, a first part 70 of sun shade main section 56 covers the display side 16 of display board 12 and a second part 72 covers a back side 18. First part 70 is substantially smaller than second part 72. This allows second part 72 to be folded and fastened or clipped so that sun shade 14 is securely mounted on display board 12. In particular, part 72 includes a folded portion 78 that has a first fold 80 overlapping a second fold 82. First and second fasteners 84 and 86 couple the first and second folds 80 and 82. First and second fasteners 84 and 86 are preferably clips that grab the folds 80 and 82, respectively, between arms 90 of the clips.

Referring to FIGS. 1 and 5, sun shade 14 is displayed on display board 12 by placing strap 58 in first notch 50 and top edge 60 of sun shade main section 56 in second notch 52 and attaching strap fastener 66 with main section fastener 68. Strap 58 is disposed around both the display side 16 and the back side 18 of board 12 with main section 56 being suspended from strap 58. Main section 56 covers second side edge 22 of board 12 with the first part 70 of main section 56 covering a portion of board display side 16 from second side edge 22 (i.e. back of the head) to about center line 46 leaving first side edge 20 (i.e. face outline) exposed.

The second part 72 of main section 56 covers the back side 18 of board 12. Second part 72 is then folded at folded portion 78 and clipped to secure sun shade 14 to display board 12. Specifically, first fold 80 is folded over second fold 82 so that first fold 80 is on the outside of second fold 82. First and second fasteners 84 and 86 are then clipped to first and second folds 80 and 82.

By displaying sun shade 14 in this manner, a potential consumer can see the sun shade prior to purchase as it would appear in normal use, i.e. the sun shade strap 58 worn over a cap of a wearer, so that the sun shade main section 56 covers the ears and the back of the neck of the wearer to protect against the environment, such as ultraviolet rays or rain. Although it is preferable to display a sun shade, display board 12 can be used to display any type of merchandise to be worn on the head of a wearer.

Figure 6:
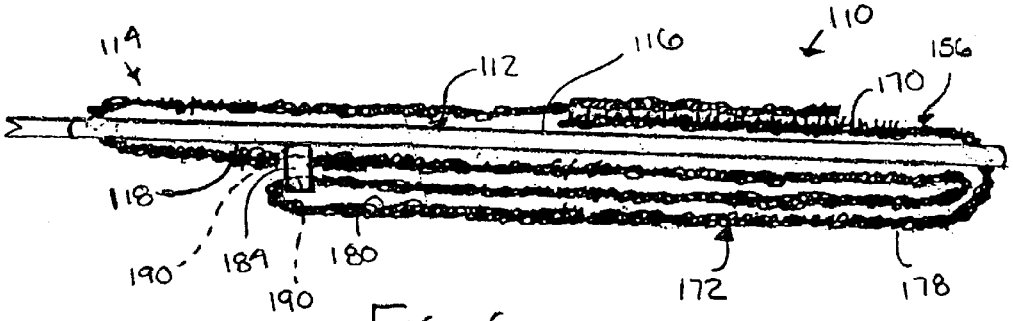
FIG. 6 is a top plan view of the merchandise display of the present invention, showing a folded portion in accordance with a second embodiment of the invention.

Second Embodiment of FIG. 6

As seen in FIG. 6, in accordance with a second embodiment of the present invention, merchandise display 110 is substantially identical to merchandise display 10 of the first embodiment except for the fold used to secure a sun shade 114 to a display board 112. In particular, like sun shade 14 of the first embodiment, a first part 170 of the main section 156 of sun shade 114 covers the display side 116 of display board 112 and a second part 172 covers a back side 118. First part 170 is substantially smaller than second part 172. This allows second part 172 to be folded and fastened or clipped so that sun shade 114 is securely mounted on display board 112. In particular, part 172 includes a folded portion 178 that has only one fold 180 overlapping second part 172. A single fastener 184 couples the fold 180 to part 172. Fastener 184 is preferably a clip that grabs fold 180, between arms 190 of the clip.

Sun shade 114 is displayed on display board 112 in the same manner as described above with respect to the first embodiment except for securing sun shade 114 to display board 112. Specifically, the second part 172 of main section 156 covers the back side 118 of board 112. Second part 172 is then folded at folded portion 178 and clipped to secure sun shade 114 to display board 112. More specifically, fold 180 is folded over part 172 so that fold 180 is on the outside of part 172. Fastener 184 is then clipped to fold 180 and part 172.

Figure 9:
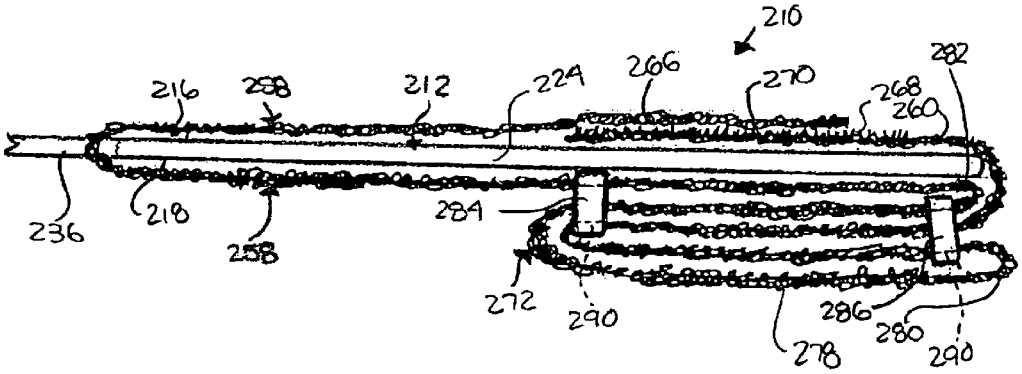
FIG. 9 is a top plan view of the merchandise display illustrated in FIG. 7, showing a folded portion of the merchandise when mounted on the display board.
Figure 7:
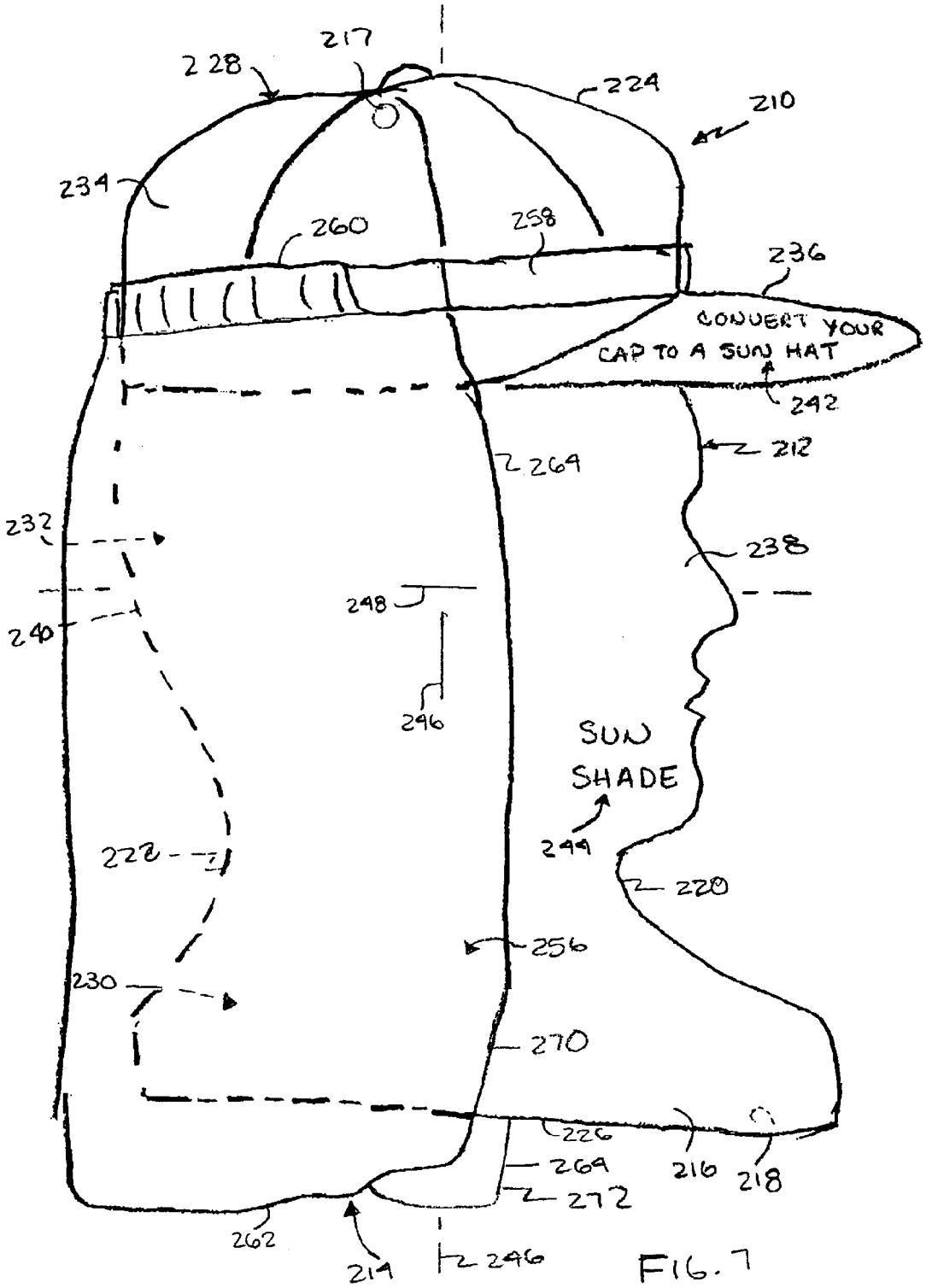
FIG. 7 is a side elevational view of the merchandise display in accordance with a third embodiment of the present invention, showing merchandise displayed on a display board.
Figure 8:
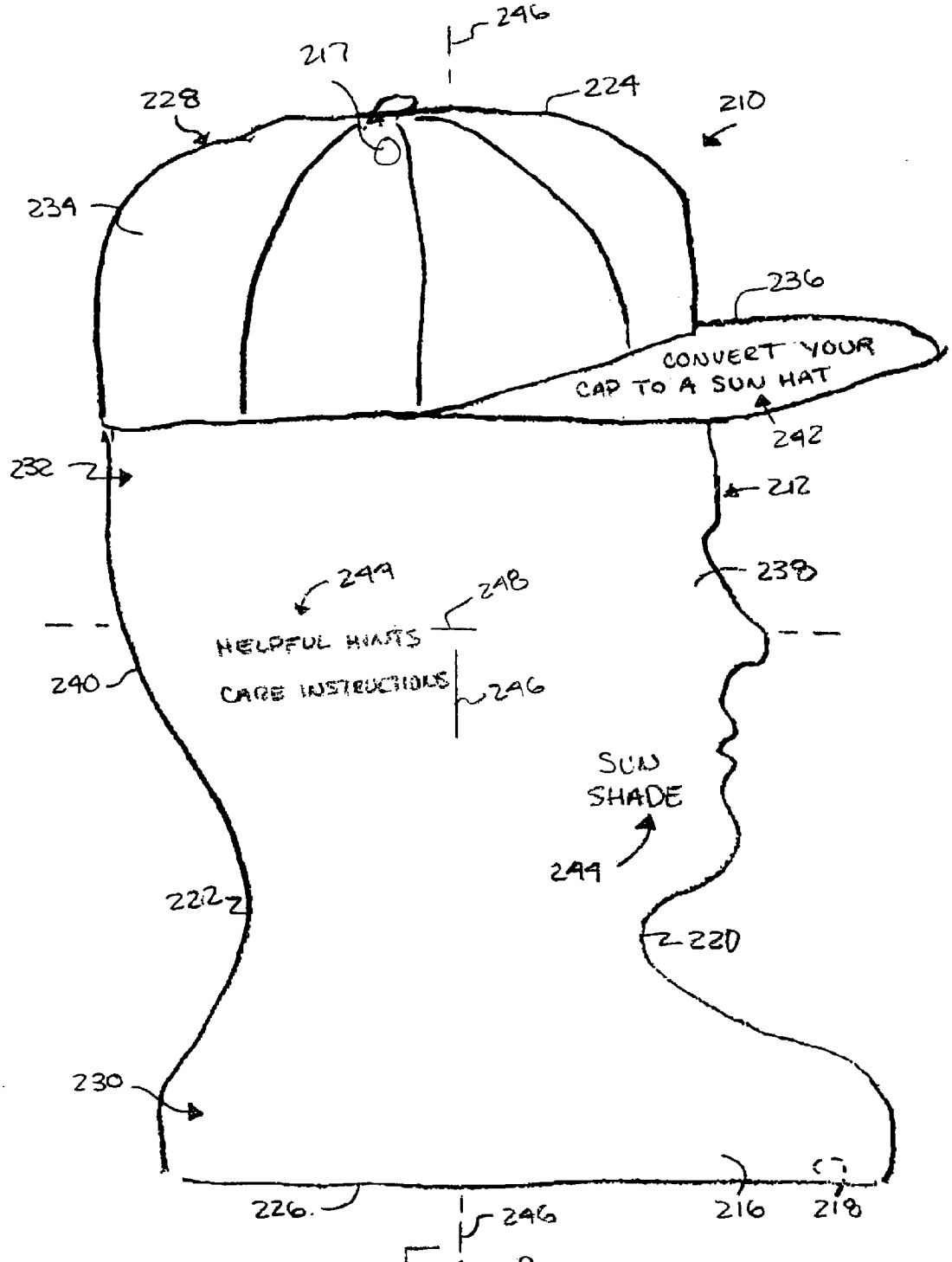
FIG. 8 is a side elevational view of the display board illustrated in FIG. 7, showing the display board without the merchandise displayed thereon.

Third Embodiment of FIGS. 7–9

Referring to FIGS. 7–9, a merchandise display 210 in accordance with a third embodiment of the present invention generally includes a display board 212 with a piece of merchandise or a product 214, such as a sun shade, mounted thereto. Display board 212 is in the form of a human profile with a cap worn thereon allowing display of sun shade 214 as it would generally appear in normal use. Display 210 is preferably supported or hung via aperture 217 in display board 212, however any known support can be used such as a stand.

Display board 212 includes a display side 216 and a back side 218 opposite display side 216. Opposite first and second side edges 220 and 222 and opposite top and bottom edges 224 and 226 define the outer perimeter of display board 212. Display board 212 includes a headwear portion 228 generally near top edge 224, a neck portion 230 generally near bottom edge 226, and a head portion 232 located between headwear portion 228 and neck portion 230 so that display board 212 depicts the profile of a human head with headwear, such as a cap, worn thereon.

As best seen in FIGS. 7 and 8, headwear portion 228 of display board 212 is preferably in the shape of a conventional cap 234, such as a stove pipe cap, including a bill 236. Head portion 232 includes an outline of a human face 238 at the first side edge 220 of display board 212, and includes an outline of the back of a human head 240 at the second side edge 222. Indicia 242 is disposed on the display side 216 of display board 212 similar to that of indicia 42 of the first embodiment. Also, indicia 244 is disposed on neck and head portions 230 and 232 on the display side 216 of board 212. Indicia 244 is similar to that of indicia 44 of the first embodiment. Display side 216 is preferably colored to provide an aesthetically pleasing appearance.

Display board 212 is preferably substantially planar and made of a semi-rigid material, such as plastic or cardboard. Display board 212 is preferably formed as a unitary one-piece board and has a length defined between top and bottom edges 224 and 226 at a center line 246 and a width defined between edges 220 and 222 at a line 248 traverse to center line 246. The length and width of display board 12 can be any dimension desired.

Sun shade 214 is substantially identical to sun shade 14 of the first embodiment and includes main section 256 and a strap 258 extending therefrom. Main section 256 has a top edge 260 from which strap 258 extends, a bottom curved edge 262, and two side edges 264. Strap preferably includes a fastener 266, such as hook and loop, that engages a corresponding fastener 268 on the top edge 260 of main section 256 as best seen in FIG. 9.

A first part 270 of sun shade main section 256 covers the display side 216 of display board 212 and a second part 272 covers a back side 218. As with the first embodiment, the second part 272 is folded and fastened or clipped so that sun shade 214 is securely mounted on display board 212. In particular, part 272 includes a folded portion 278 that has a first fold 280 overlapping a second fold 282. First and second fasteners 284 and 286 couple the first and second folds 280 and 282. First and second fasteners 284 and 286 are preferably clips that grab the folds 280 and 282, respectively, between arms (not shown) of the clips.

Referring to FIGS. 7 and 9, sun shade 214 is displayed on display board 212 by placing strap 258 around display and back sides 216 and 218 so that strap 258 engages first side edge 220 of display board 212 above bill 236. Top edge 260 of sun shade main section 256 engages second edge 222 opposite the strap 258. Strap fastener 266 is then attached to main section fastener 268. Strap 258 is disposed around both the display side 216 and the back side 218 of board 212 with main section 256 being suspended from strap 258. Main section 256 covers second side edge 222 of board 212 with the first part 270 of main section 256 covering a portion of board display side 216 from second side edge 222 (i.e. back of the head) to about center line 246 leaving first side edge 220 (i.e. face outline) exposed.

The second part 272 of main section 256 covers the back side 218 of board 212. Second part 272 is then folded at folded portion 278 and clipped to secure sun shade 214 to display board 212. Specifically, first fold 280 is folded over second fold 282 so that first fold 280 is on the outside of second fold 282. First and second fasteners 284 and 286 are then clipped to first and second folds 280 and 282. By displaying sun shade 214 in this manner, a potential consumer can see the sun shade prior to purchase as it would appear in normal use. Although, it is preferable to display a sun shade, display board 212 can be used to display any type of merchandise to be worn on the head of a wearer.

While particular embodiments have been chosen to illustrate the invention, it will be understood by those skilled in the art that various changes and modifications can be made therein without departing from the scope of the invention as defined in the appended claims.

What is claimed is:

1. A merchandise display, comprising a substantially planar display board having the form of a profile of a human head with a headwear portion, a head portion, and a neck portion; and merchandise mounted to said display board, said merchandise including a main section and a strap, said strap being mounted to said headwear portion of said display board with said main section being suspended from said strap and covering a part of said head portion, thereby displaying said merchandise on said display board as said merchandise would appear in normal use, and said display board including opposite first and second side edges, and a first notch for receiving said strap located on one of said first and second side edges.

2. A merchandise display according to claim 1, wherein said display board includes a second notch for receiving said main section of said merchandise; and said second notch is located at said headwear portion on one of said first and second side edges.

3. A merchandise display according to claim 1, wherein said first side edge has a shape of the profile of a human face; and said main section of said merchandise covers said second side edge of said display board without covering said first side edge.

4. A merchandise display according to claim 1, wherein said strap is disposed around said headwear portion on first and second opposing sides of said display board.

5. A merchandise display according to claim 1, wherein said display board includes a display side having indicia located thereon.

6. A merchandise display according to claim 5, wherein said indicia includes instructions.

7. A merchandise display according to claim 1, wherein said main section of said merchandise includes a folded portion at a side of said display board opposite a display side of said display board.

8. A merchandise display according to claim 7, wherein at least one fastener is coupled to said folded portion of said main section.

9. A merchandise display according to claim 1, wherein said headwear portion has the shape of a cap including a bill.

10. A merchandise display according to claim 9, wherein said notch is located near said bill.

11. A merchandise display according to claim 9, wherein said strap is disposed above said bill.

12. A merchandise display according to claim 9, wherein said headwear portion includes indicia of markings of a cap.

13. A merchandise display according to claim 1, wherein said display board includes a second notch;

said strap extends from a top edge of said main section of said merchandise;

said strap is received in said first notch; and said top edge is received in said second notch.

14. A merchandise display according to claim 13, wherein said first notch is disposed on said first side edge of said display board; and said second notch is located on said second side edge of said display board opposite said first side edge.

15. A merchandise display according to claim 1, wherein said merchandise is made of fabric that substantially blocks ultraviolet rays.

16. A merchandise display, comprising:

a substantially planar display board having the form of a profile of a human head with a headwear portion having the shape of a cap including a bill, a head portion, a neck portion, and first and second opposing side edges, and indicia disposed on a display side of said display board; and merchandise mounted to said display board, said merchandise including a flexible main section and a flexible strap extending from a top edge of said main section, said strap being mounted to said headwear portion of said display board and engaging said first side edge of said of said display board and said top edge of said main section engaging said second side edge of said display board with said main section being suspended from said strap and covering said second side edge of said display board, thereby displaying said merchandise on said display board as said merchandise would appear in normal use.

17. A merchandise display according to claim 16, wherein said display board includes a first notch at said first edge; and said strap is received in said first notch.

18. A merchandise display according to claim 17, wherein said display board includes a second notch at said second edge; and said top edge of said main section is received in said second notch.

19. A merchandise display according to claim 16, wherein said main section includes a folded portion having at least one fold, said folded portion is disposed a side of said display board opposite said display side of said display board.

20. A merchandise display, comprising:

a substantially planar display board having the form of a profile of a human head with a headwear portion, a head portion, and a neck portion; and merchandise mounted to said display board, said merchandise including a main section and a strap, said main section having a folded portion at a side of said display board opposite a display side of said display board, and said strap being mounted to said headwear portion of said display board with said main section being suspended from said strap and covering a part of said head portion, thereby displaying said merchandise on said display board as said merchandise would appear in normal use.

21. A merchandise display according to claim 20, wherein said display board includes opposite first and second side edges;

said first side edge has a shape of the profile of a human face; and said main section of said merchandise covers said second side edge of said display board without covering said first side edge.

22. A merchandise display according to claim 20, wherein said strap is disposed around said headwear portion on first and second opposing sides of said display board.

23. A merchandise display according to claim 20, wherein said display board includes a display side having indicia located thereon.

24. A merchandise display according to claim 23, wherein said indicia includes instructions.

25. A merchandise display according to claim 20, wherein at least one fastener is coupled to said folded portion of said main section.

26. A merchandise display according to claim 20, wherein said headwear portion has the shape of a cap including a bill.

27. A merchandise display according to claim 26, wherein a notch is located near said bill.

28. A merchandise display according to claim 26, wherein said strap is disposed above said bill.

29. A merchandise display according to claim 26, wherein said headwear portion includes indicia of markings of a cap.

30. A merchandise display according to claim 20, wherein said display board includes a first and second notch;

said strap extends from a top edge of said main section of said merchandise;

said strap is received in said first notch; and said top edge is received in said second notch.

31. A merchandise display according to claim 30, wherein said first notch is disposed on a first side edge of said display board; and said second notch is located on a second side edge of said display board opposite said first side edge.

32. A merchandise display according to claim 20, wherein said merchandise is made of fabric that substantially blocks ultraviolet rays.

33. A merchandise display, comprising:

a substantially planar display board having the form of a profile of a human head with a headwear portion having the shape of a cap including a bill, a head portion, and a neck portion; and merchandise mounted to said display board, said merchandise including a main section and a strap, said strap being mounted to said headwear portion of said display board with said main section being suspended from said strap and covering a part of said head portion, thereby displaying said merchandise on said display board as said merchandise would appear in normal use.

34. A merchandise display according to claim 33, wherein said display board includes opposite first and second side edges;

said first side edge has a shape of the profile of a human face; and said main section of said merchandise covers said second side edge of said display board without covering said first side edge.

35. A merchandise display according to claim 33, wherein said strap is disposed around said headwear portion on first and second opposing sides of said display board.

36. A merchandise display according to claim 33, wherein said display board includes a display side having indicia located thereon.

37. A merchandise display according to claim 36, wherein said indicia includes instructions.

38. A merchandise display according to claim 33, wherein said main section of said merchandise includes a folded portion at a side of said display board opposite a display side of said display board.

39. A merchandise display according to claim 38, wherein at least one fastener is coupled to said folded portion of said main section.

40. A merchandise display according to claim 33, wherein a notch is located near said bill.

41. A merchandise display according to claim 33, wherein said strap is disposed above said bill.

42. A merchandise display according to claim 33, wherein said headwear portion includes indicia of markings of a cap.

43. A merchandise display according to claim 33, wherein said display board includes a first and second notch;

said strap extends from a top edge of said main section of said merchandise;

said strap is received in said first notch; and said top edge is received in said second notch.

44. A merchandise display according to claim 43, wherein said first notch is disposed on a first side edge of said display board; and said second notch is located on a second side edge of said display board opposite said first side edge.

45. A merchandise display according to claim 33, wherein said merchandise is made of fabric that substantially blocks ultraviolet rays.

46. A merchandise display, comprising:

a substantially planar display board having the form of a profile of a human head with a headwear portion, a head portion, and a neck portion, and having first and second notches; and merchandise mounted to said display board, said merchandise including a main section with a top edge received in said second notch of said display board and a strap extending from said top edge and being mounted to said headwear portion of said display board, said strap being received in said first notch of said display board with said main section being suspended from said strap and covering a part of said head portion, thereby displaying said merchandise on said display board as said merchandise would appear in normal use.

47. A merchandise display according to claim 46, wherein said first notch is disposed on a first side edge of said display board; and said second notch is located on a second side edge of said display board opposite said first side edge.

48. A merchandise display according to claim 46, wherein said merchandise is made of fabric that substantially blocks ultraviolet rays.

49. A merchandise display according to claim 46, wherein said display board includes a display side having indicia located thereon.

50. A merchandise display according to claim 46, wherein said headwear portion has the shape of a cap including a bill.

* * * * *